US006234920B1

(12) United States Patent
Wang

(10) Patent No.: US 6,234,920 B1
(45) Date of Patent: May 22, 2001

(54) SHOCK-ABSORBING AND SKIDPROOF PROTECTIVE JACKET OF GAME RACKET HANDLE

(75) Inventor: Jack Wang, Taichung Hsien (TW)

(73) Assignee: High Cedar Enterprise Co., Taichung Hsien (TW)

( * ) Notice: Subject to any disclaimer, the term of this patent is extended or adjusted under 35 U.S.C. 154(b) by 0 days.

(21) Appl. No.: 09/460,371

(22) Filed: Dec. 13, 1999

(51) Int. Cl.[7] ..... A63B 49/00
(52) U.S. Cl. ..... 473/523; 473/568; 473/301
(58) Field of Search ..... 473/523, 549, 473/551, 520, 568, 300, 301, 302, 303, FOR 173, FOR 183

(56) References Cited

U.S. PATENT DOCUMENTS 2,046,164 * 6/1936 Herkner ..... 473/302
2,793,136 * 5/1957 Root ..... 473/303
4,053,676 * 10/1977 Kaminstein ..... 473/549 X
4,284,275 * 8/1981 Fletcher ..... 473/549
5,275,407 * 1/1994 Soong ..... 473/549
5,475,894 * 12/1995 Wildforster ..... 16/111 R
5,851,632 * 12/1998 Chen et al. ..... 473/549 X

* cited by examiner

*Primary Examiner*—Raleigh W. Chiu
(74) *Attorney, Agent, or Firm*—Browdy & Neimark

(57) ABSTRACT

A shock-absorbing and skidproof protective jacket of a game racket handle comprises a foundation layer and a top layer which is adhered to the upper surface of the foundation layer and is provided with one or more shock-absorbing sections and skidproof sections arranged alternately with the shock-absorbing sections. The shock-absorbing sections are made of polyesters, whereas the skidproof sections are made of a mixture containing a plurality of plastic or rubber granules and a binder.

18 Claims, 2 Drawing Sheets

SHOCK-ABSORBING AND SKIDPROOF PROTECTIVE JACKET OF GAME RACKET HANDLE

FIELD OF THE INVENTION

The present invention relates generally to a protective jacket of a game racket handle, and more particularly to a shock-absorbing and skidproof protective jacket of the game racket handle.

BACKGROUND OF THE INVENTION

The conventional protective jacket of a game racket handle is generally made of a piece of nonwoven cloth, which is covered with a coating of polyurethane (PU). In view of the PU coating having a high coefficient of elasticity, the game racket handle is capable of absorbing shock. However, the PU coating is smooth and prone to become slippery by perspiration of the hand holding the handle. As a result, the handle must be held fast by the hand to compensate the wet and slippery surface of the PU coating of the handle. The shock-absorbing effect of the PU coating is thus discounted.

In order to overcome the deficiency of the conventional protective jacket described above, the PU coating is provided with a nap by polishing and grinding, or with a depression by grinding, so as to increase the friction coefficient of the protective jacket. The polishing and the grinding processes result in a substantial increase in the cost of making the protective jacket.

Some of the conventional protective jackets are provided thereon with one or more raised ribs, which are rather limited in the skidproof effect. In addition, the raised ribs can cause discomfort to the hand holding the game racket handle.

SUMMARY OF THE INVENTION

The primary objective of the present invention is to provide a game racket handle with a protective jacket having the shock-absorbing and the skidproof effects.

In keeping with the principle of the present invention, the foregoing objective of the present invention is attained by the protective jacket comprising a foundation layer and a top layer. The foundation layer has an upper surface, and an underside which is attached to the surface of the game racket handle. The top layer is attached with the upper surface and is provided with at least one shock-absorbing section and at least one skidproof section. The shock-absorbing section is made of polyurethane, whereas the skidproof section is formed of a plurality of granules, which are mixed with an adhesive.

DETAILED DESCRIPTION OF THE INVENTION

Figure 1:
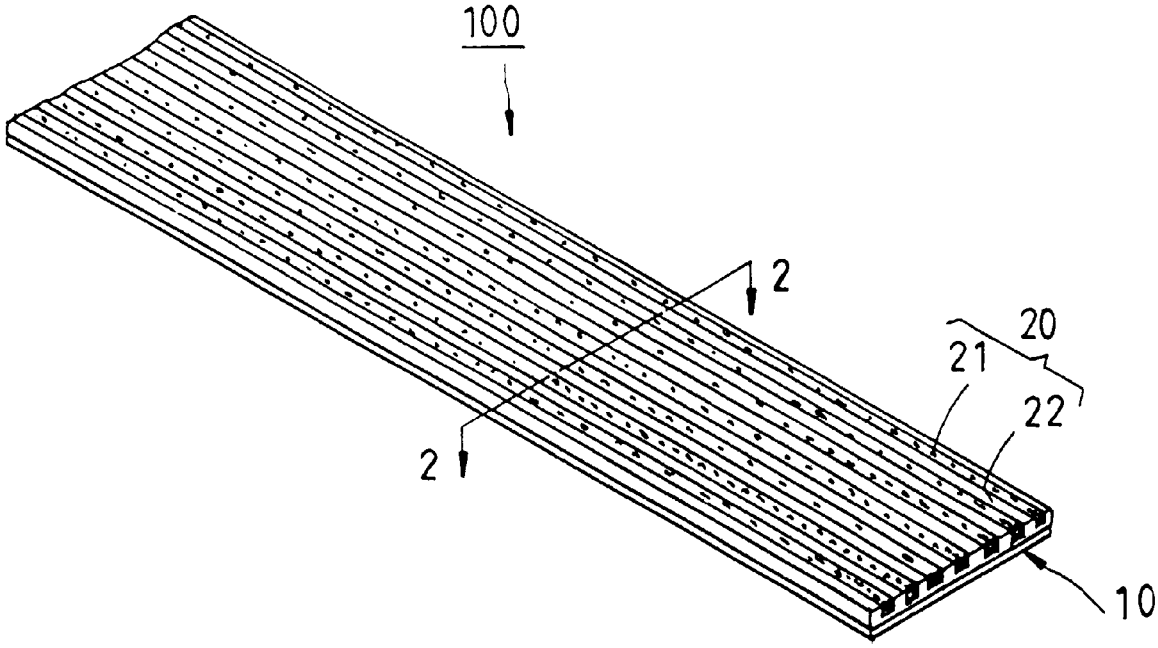
FIG. 1 shows a perspective view of a first preferred embodiment of the present invention.
Figure 2:
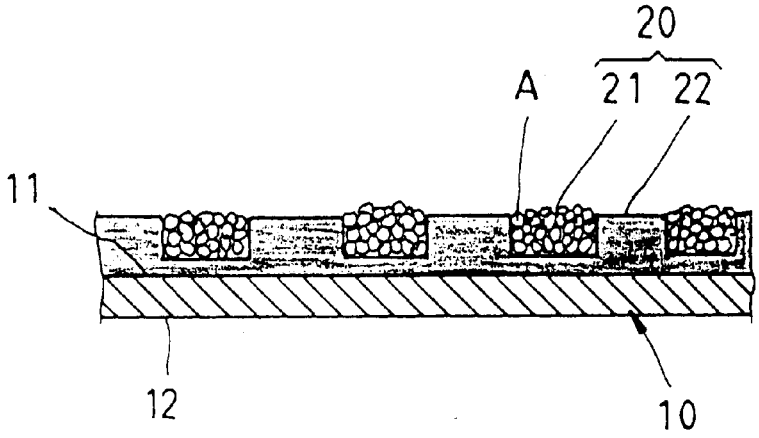
FIG. 2 shows a sectional view taken along the direction indicated by a line 2—2 as shown in FIG. 1.

As shown in FIGS. 1 and 2, a shock-absorbing and skidproof protective jacket 100 of the first preferred embodiment of the present invention is intended for use in covering the handle of a game racket. The protective jacket 100 is composed of a foundation layer 10 and a top layer 20.

The foundation layer 10 is made of a woven or nonwoven cloth. The foundation layer 10 has an upper surface 11, and an underside 12 which is adhered to the surface of the handle of the game racket.

The top layer 20 is adhered to the upper surface 11 of the foundation layer 10 and is provided with a plurality of skidproof sections 21 and shock-absorbing sections 22, which are arranged alternately at an interval.

The skidproof sections 21 are made of a plurality of rubber granules "A" which are mixed with a resin binder. The skidproof sections 21 have a rugged outer surface. The granules "A" may be made of a plastic or elastic material.

The shock-absorbing sections 22 are made of polyesters by coating and air drying. The shock-absorbing sections 22 are not level with the skidproof sections 21 such that the shock-absorbing sections 22 are lower.

The process of making the protective jacket 100 of the present invention involves the use of a conveyer by which the foundation layer 10 is carried through a coating trough (not shown in the drawing) containing a mixture of polyurethane. Upon completion of the air drying process, a PU coating is formed on the upper surface 11 of the foundation layer 10. The PU coating is then provided with a plurality of parallel grooves which are formed by a forming machine under heat and pressure. The shock-absorbing sections 22 are formed between the grooves. The grooves are filled with the granules "A" mixed with the resin binder. The mixture of the granules and the resin binder forms the skidproof sections 21 such that the granules are projected beyond the surface of the shock-absorbing sections 22 so as to provide the skidproof sections 21 with a greater friction coefficient. The granules may be various in size, depending on the nature of the duty of the protective jacket 100. According to the results of tests conducted by this inventor of the present invention, those granules which are screened by a screen filter "60" have the optimum size in terms of the grip feel and the friction force.

Figure 3:
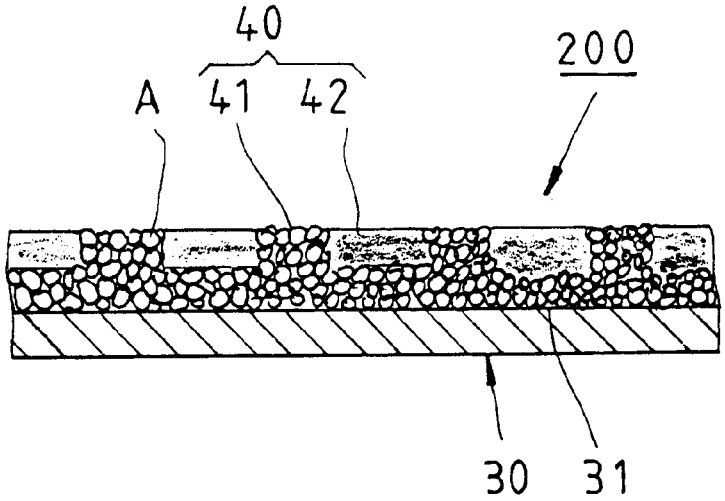
FIG. 3 shows a sectional view of a second preferred embodiment of the present invention.

As shown in FIG. 3, a protective jacket 200 of the second preferred embodiment of the present invention is formed of a foundation layer 30 which is provided on an upper surface 31 thereof with the mixture of the granules "A" and the binder to form a top layer 40 of the protective jacket 200. The top layer 40 is provided thereon with a plurality of skidproof sections 41 of a ribbed construction. A plurality of shock-absorbing sections 42 of polyurethane are formed between the skidproof sections 41. In light of the bottom of the skidproof sections 41 are in direct contact with the upper surface 31 of the foundation layer 30 of the nonwoven cloth, the hand perspiration is absorbed by the foundation layer 30 via interstices between the granules.

Figure 4:
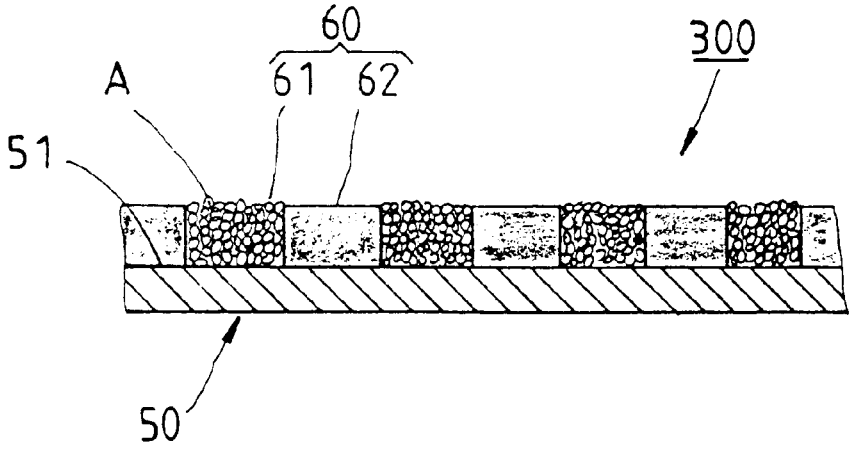
FIG. 4 shows a sectional view of a third preferred embodiment of the present invention.

FIG. 4 shows a protective jacket 300 of the third preferred embodiment of the present invention. The protective jacket 300 is formed of a foundation layer 50 having an upper surface 51 on which a top layer 60 is laid. The top layer 60 is provided with a plurality of skidproof sections 61 and shock-absorbing sections 62, which are alternately arranged such that the bottoms of the sections 61 and 62 are in direct contact with the upper surface 51 of the foundation layer 50.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A shock-absorbing and skidproof protective jacket for a game racket handle, said protective jacket comprising:

a foundation layer having an upper surface and an underside adapted to be attached to the game racket handle; and a top layer adhered to said upper surface of said foundation layer and provided with at least one shock-absorbing section and at least on skidproof section, said shock-absorbing section being made of a polyesters material, said skidproof section being made of a mixture containing a plurality of granules and a binder;

wherein said top layer is formed on said foundation layer by said polyesters material and is provided with a plurality of projected ribs arranged alternately to form said shock-absorbing section; and wherein said skidproof section is formed of said granules arranged between adjoining shock-absorbing sections.

2. The protective jacket as defined in claim 1, wherein said polyesters material is polyurethane.

3. The protective jacket as defined in claim 1, wherein said binder is a resin binder.

4. The protective jacket as defined in claim 1, wherein said granules are rubber granules.

5. The protective jacket as defined in claim 1, wherein said granules are plastic granules.

6. The protective jacket as defined in claim 1, wherein said granules are screened by a screen filter "60".

7. A shock-absorbing and skidproof protective jacket for a game racket handle, said protective jacket comprising:

a foundation layer having an upper surface and an underside adapted to be attached to the game racket handle; and a top layer adhered to said upper surface of said foundation layer and provided with at least one shock-absorbing section and at least on skidproof section, said shock-absorbing section being made of a polyesters material, said skidproof section being made of a mixture containing a plurality of granules and a binder;

wherein said top layer is formed on said foundation layer by said granules and is provided with a plurality of granular projected ribs arranged alternately to form said skidproof section; and wherein said shock-absorbing section is formed of said polyurethane material arranged between adjoining skid-proof sections.

8. The protective jacket as defined in claim 7, wherein said polyesters material is polyurethane.

9. The protective jacket as defined in claim 7, wherein said binder is a resin binder.

10. The protective jacket as defined in claim 7, wherein said granules are rubber granules.

11. The protective jacket as defined in claim 7, wherein said granules are plastic granules.

12. The protective jacket as defined in claim 7, wherein said granules are screened by a screen filter "60".

13. A shock-absorbing and skidproof protective jacket for a game racket handle, said protective jacket comprising:

a foundation layer having an upper surface and an underside adapted to be attached to the game racket handle; and a top layer adhered to said upper surface of said foundation layer and provided with at least one shock-absorbing section and at least on skidproof section, said shock-absorbing section being made of a polyesters material, said skidproof section being made of a mixture containing a plurality of granules and a binder;

wherein bottoms of said skidproof section and said shock-absorbing section of said top layer are in direct contact with said upper surface of said foundation layer.

14. The protective jacket as defined in claim 13, wherein said polyesters material is polyurethane.

15. The protective jacket as defined in claim 13, wherein said binder is a resin binder.

16. The protective jacket as defined in claim 13, wherein said granules are rubber granules.

17. The protective jacket as defined in claim 13, wherein said granules are plastic granules.

18. The protective jacket as defined in claim 13, wherein said granules are screened by a screen filter "60".

* * * * *